US009040169B2

(12) United States Patent
Hamada et al.

(10) Patent No.: US 9,040,169 B2
(45) Date of Patent: May 26, 2015

(54) HOT-DIP GALVANIZED STEEL SHEET AND ALLOYED HOT-DIP GALVANIZED STEEL SHEET, EACH HAVING EXCELLENT WORKABILITY, HIGH YIELD RATIO AND HIGH STRENGTH

(75) Inventors: Kazuyuki Hamada, Kakogawa (JP); Tatsuya Asai, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 291 days.

(21) Appl. No.: 13/635,768

(22) PCT Filed: Mar. 30, 2011

(86) PCT No.: PCT/JP2011/058007

§ 371 (c)(1),
(2), (4) Date: Sep. 18, 2012

(87) PCT Pub. No.: WO2011/125738

PCT Pub. Date: Oct. 13, 2011

(65) Prior Publication Data

US 2013/0017411 A1 Jan. 17, 2013

(30) Foreign Application Priority Data

Mar. 31, 2010 (JP) ..... 2010-084468

(51) Int. Cl.
*B32B 15/00* (2006.01)
*C22C 38/06* (2006.01)
(Continued)

(52) U.S. Cl.
CPC ..... *C22C 38/06* (2013.01); *Y10T 428/12799* (2015.01); *C21D 8/0236* (2013.01);
(Continued)

(58) Field of Classification Search
None
See application file for complete search history.

(56) References Cited

U.S. PATENT DOCUMENTS

2003/0084966 A1 5/2003 Ikeda et al.
2007/0023113 A1 2/2007 Ikeda et al.
(Continued)

FOREIGN PATENT DOCUMENTS

CN 101649415 A 2/2010
EP 2 157 203 A1 2/2010
(Continued)

OTHER PUBLICATIONS

International Search Report Issued Jun. 28, 2011 in PCT/JP11/058007 Filed Mar. 30, 2011.
(Continued)

*Primary Examiner* — Mark Ruthkosky
*Assistant Examiner* — Daniel J Schleis
(74) *Attorney, Agent, or Firm* — Oblon, McClelland, Maier & Neustadt, L.L.P.

(57) ABSTRACT

Disclosed is a hot-dip galvanized steel sheet or an alloyed hot-dip galvanized steel sheet, which has a tensile strength of 980 MPa or more, excellent workability, high yield ratio and high strength. The hot-dip galvanized steel sheet or the alloyed hot-dip galvanized steel sheet is characterized by containing 0.12-0.3% by mass of C, 0.1% by mass or less (excluding 0% by mass) of Si, 2.0-3.5% by mass of Mn, 0.05% by mass or less (excluding 0% by mass) of P, 0.05% by mass or less (excluding 0% by mass) of S, 0.005-0.1% by mass of Al and 0.015% by mass or less (excluding 0% by mass) of N, with the balance made up of iron and unavoidable impurities. The hot-dip galvanized steel sheet or the alloyed hot-dip galvanized steel sheet is also characterized in that the metallic structure thereof contains bainite as a matrix structure, and the area ratio of ferrite is 3-20% and the area ratio of martensite is 10-35% relative to the entire structure.

17 Claims, 2 Drawing Sheets

(51) Int. Cl.

| | |
|---|---|
| ***C21D 8/02*** | (2006.01) |
| ***C21D 9/46*** | (2006.01) |
| ***C21D 9/48*** | (2006.01) |
| ***C22C 38/00*** | (2006.01) |
| ***C22C 38/04*** | (2006.01) |
| ***C22C 38/22*** | (2006.01) |
| ***C22C 38/28*** | (2006.01) |
| ***C22C 38/38*** | (2006.01) |
| ***C23C 2/06*** | (2006.01) |
| ***C23C 2/28*** | (2006.01) |
| ***C21D 8/04*** | (2006.01) |

(52) U.S. Cl.

CPC ..... *C21D8/0273* (2013.01); *C21D 9/46* (2013.01); *C21D 9/48* (2013.01); *C21D 2211/002* (2013.01); *C21D 2211/005* (2013.01); *C21D 2211/008* (2013.01); *C22C 38/001* (2013.01); *C22C 38/04* (2013.01); *C22C 38/22* (2013.01); *C22C 38/28* (2013.01); *C22C 38/38* (2013.01); *C23C 2/06* (2013.01); *C23C 2/28* (2013.01); *C21D 8/0473* (2013.01)

(56) References Cited

U.S. PATENT DOCUMENTS

| | | | | |
|---|---|---|---|---|
| 2010/0037995 | A1 | 2/2010 | Watanabe | |
| 2010/0112377 | A1* | 5/2010 | Kaneko et al. | 428/659 |
| 2010/0132849 | A1 | 6/2010 | Takagi et al. | |
| 2010/0218857 | A1* | 9/2010 | Nakagaito et al. | 148/533 |
| 2011/0008546 | A1* | 1/2011 | Suzuki et al. | 427/431 |
| 2011/0036465 | A1* | 2/2011 | Kawasaki et al. | 148/533 |

FOREIGN PATENT DOCUMENTS

| | | | |
|---|---|---|---|
| FR | 2 830 260 | A1 | 4/2003 |
| GB | 2 382 590 | A | 6/2003 |
| JP | 7 197121 | | 8/1995 |
| JP | 2003 247045 | | 9/2003 |
| JP | 2006 52445 | | 2/2006 |
| JP | 2010 65316 | | 3/2010 |
| KR | 10-2009-0122372 | | 11/2009 |
| KR | 10-2010-0020433 | A | 2/2010 |
| WO | WO2009054539 | * | 4/2009 |

OTHER PUBLICATIONS

International Search Report issued Jun. 28, 2011 in PCT/JP2011/058007 with English language translation.

* cited by examiner

HOT-DIP GALVANIZED STEEL SHEET AND ALLOYED HOT-DIP GALVANIZED STEEL SHEET, EACH HAVING EXCELLENT WORKABILITY, HIGH YIELD RATIO AND HIGH STRENGTH

This application is a National Stage of PCT/JP11/058007 filed Mar. 30, 2007 and claims the benefit of JP 2010-084468 filed Mar. 31, 2010.

TECHNICAL FIELD

The present invention relates to a hot-dip galvanized steel sheet and an alloyed hot-dip galvanized steel sheet (may be hereinafter expressed as a galvanized steel sheet) having excellent workability, high yield ratio and high strength, and relates specifically to a high strength galvanized steel sheet with 980 MPa or more tensile strength whose yield ratio is increased without deteriorating workability. The galvanized steel sheet of the present invention is used suitably for example to structural members for automobiles that require high workability and high yield strength (for example a body skeletal member such as a pillar, member, reinforce groups, and the like; a strength member such as a bumper, door guard bar, seat part, under carriage component and the like), members for electric appliances, and the like.

BACKGROUND ART

In recent years, because of growing awareness about global environmental problems, respective automobile manufacturers have reduced the weight of a vehicle body with the aim of improving the fuel economy. Also, from a viewpoint of safety of passengers, safety standard against collision of an automobile has become stricter, and durability of a member to a shock also has been required. Therefore, in recent automobiles, the use ratio of high strength steel sheets has further increased, and particularly in vehicle body skeletal members and reinforce members that require corrosion resistance, hot-dip galvanized steel sheets or alloyed hot-dip galvanized steel sheets having high strength have been positively applied. Under expansion of use applications of high strength steel sheets, the required properties have risen, and improvement of workability of a base metal has been required further more in hard-to-form members.

As a steel sheet having both of strength and workability, there is a dual-phase steel sheet (may be hereinafter referred to as a DP steel sheet) mainly composed of ferrite having high elongation and martensite exerting high strength. Also, as a high strength steel sheet achieving both of high workability and high yield ratio, in the Patent Literature 1 for example, a hot-dip galvanized high-tensile steel sheet is disclosed that has the strength of 780 MPa or more, excellent elongation, and the yield ratio of 60-80% which is achieved by making the average grain size of ferrite 5.0 μm or less and making the average grain size of the hard second phase 5.0 μm or less. According to the technology disclosed in the literature, precipitation strengthening elements of Ti and Nb are added to strengthen precipitation and to strengthen miniaturization of the structure, however Ti and Nb are required to be added by a great amount, and therefore there is a problem from the viewpoint of the cost.

In the meantime, with respect to a high strength hot-dip galvanized steel sheet for a vehicle body skeleton, energy absorption performance in collision is required in addition to workability, and a technology for manufacturing a steel sheet with high yield strength or high yield ratio at a low cost has been required. However, the DP steel sheet exhibits a low yield ratio, and does not achieve both of high yield ratio and high workability. Also, in the Patent Literature 1, a steel sheet achieving both of high yield ratio and high workability is shown, however there is a problem on the manufacturing cost. Therefore, materialization of a technology that allows manufacture of a high strength galvanized steel sheet exhibiting high yield ratio and excellent workability at a low cost is desired.

CITATION LIST

Patent Literature

[Patent Literature 1] Japanese Unexamined Patent Application Publication No. 2006-52445

SUMMARY OF INVENTION

Technical Problems

The present invention has been developed in view of the situations described above, and its object is to provide a hot-dip galvanized steel sheet and an alloyed hot-dip galvanized steel sheet that have 980 MPa or more tensile strength, exhibit high yield ratio, and are excellent in workability (more specifically, TS-EL balance and TS-λ balance).

Solution to Problem

The galvanized steel sheet in relation with the present invention that could solve the problems described above is a high strength galvanized steel sheet having a tensile strength of 980 MPa or more, excellent workability and high yield ratio having a hot-dip zinc plating layer or an alloyed hot-dip zinc plating layer on the surface of the steel sheet including C: 0.12-0.3% (means mass %, hereinafter the same with respect to chemical componential composition), Si: 0.1% or less (excluding 0%), Mn: 2.0-3.5%, P: 0.05% or less (excluding 0%), S: 0.05% or less (excluding 0%), Al: 0.005-0.1%, N: 0.015% or less (excluding 0%) with the balance being iron and unavoidable impurities, in which metallic structure thereof contains bainite as a matrix structure, an area ratio of ferrite is 3-20% and an area ratio of martensite is 10-35% in terms of a ratio to entire structure.

In a preferred embodiment of the present invention, the galvanized steel sheet further includes one element or more selected from a group consisting of Cr: 1.0% or less (excluding 0%), Mo: 1.0% or less (excluding 0%), and B: 0.01% or less (excluding 0%).

The galvanized steel sheet further including Ti: 0.3% or less (excluding 0%) and/or V: 0.3% or less (excluding 0%) is also a preferred embodiment.

Advantageous Effect of Invention

The high strength galvanized steel sheet in relation with the present invention contains bainite as a matrix structure, is appropriately controlled with respect to the fractions of ferrite and martensite that are the second phase structure, therefore has the tensile strength of 980 MPa or more, exhibits high yield ratio (particularly 65% or more), and is excellent in workability. In the present specification, "excellent in workability" means to be excellent in TS-EL balance (and TS-λ balance) when the tensile strength is 980 MPa or more. More specifically, it means to satisfy [tensile strength (TS: MPa)× elongation (EL: %)/100]≥130 in the high strength range described above. It is preferable that the value TS×EL/100 is 140 or more. Further, in the high strength range described above, [tensile strength (TS: MPa)×hole expansion ratio (λ: %)/100]≥210 is preferable, and it is more preferable that the value TS×λ/100 is 220 or more.

DESCRIPTION OF EMBODIMENTS

Figure 1:
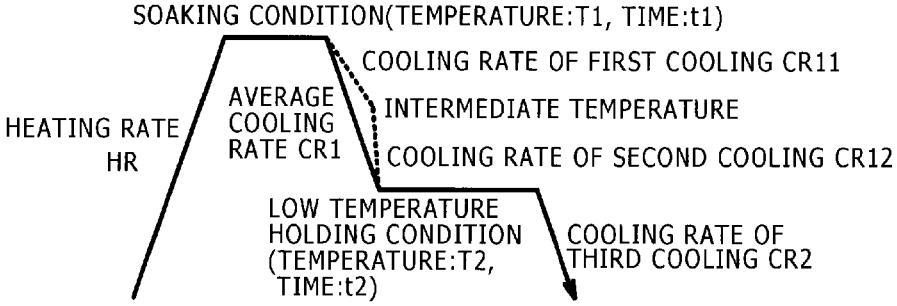
FIG. 1 is a schematic drawing showing a heat pattern in manufacturing the steel sheet of the present invention.

As described above, as a steel sheet having both of strength and workability, a DP steel sheet mainly composed of ferrite and martensite can be cited, however in the DP steel sheet, mobile dislocation is introduced in ferrite in martensitic transformation, and therefore the yield ratio drops. Accordingly, the present inventors established a fundamental concept to achieve a high yield ratio by making bainite a matrix structure (main phase) and by suppressing respective fractions of martensite generating mobile dislocation and ferrite to which mobile dislocation is introduced compared with those in the DP steel sheets of prior arts. However, by introduction of bainite, ferrite relatively decreases thereby the elongation is liable to drop, and martensite relatively decreases thereby the strength is liable to drop. Also, even when bainite is the main phase, if fractions of martensite and ferrite are comparatively high, high yield ratio may possibly hard to be achieved. Therefore, intensive researches were conducted on respective fractions of ferrite and martensite while making bainite the main phase so as to achieve all properties of high strength, high yield ratio and high workability. As a result, an optimum range has been found out on the fractions of these structures, and the present invention has been completed.

Below, the range of the structural fractions and the reason of setting the same will be described in detail.

[Fraction of Ferrite: 3-20 Area %]

Ferrite is important as a structure contributing to improvement of elongation property, and, in order to secure the elongation property, the fraction of ferrite to the entire structure is to be 3 area % or more, preferably 5 area % or more. On the other hand, in order to secure a bainite structure and achieve a high yield ratio, the fraction of ferrite should be suppressed to 20 area % or less, preferably 18 area % or less.

[Fraction of Martensite: 10-35 Area %]

Martensite is a structure required for securing high strength, and, in the present invention, the fraction of martensite to the entire structure is to be 10 area % or more, preferably 15 area % or more. On the other hand, in order to secure a bainite structure and achieve a high yield ratio, the fraction of martensite should be suppressed to 35 area % or less, preferably 30 area % or less.

[Matrix Structure: Bainite]

As described above, in the steel sheet of the present invention, bainite is to be the matrix structure (main phase). "Matrix structure" in the present invention means the structure that occupies the largest ratio to the entire structure. When the steel is composed of three phases only of bainite, ferrite and martensite, the fraction of bainite becomes 45 area % or more from the upper limit values of the fraction of ferrite and the fraction of martensite, and the bainite structure becomes the "matrix structure". Also, in the present invention, retained austenite possibly formed in the manufacturing process is to be included in martensite.

Although the steel sheet of the present invention may be composed of three phases only of bainite, ferrite and martensite, it may include a structure formed unavoidably through the manufacturing process and the like for example within a limit not obstructing the action of the present invention. As such the structure, pearlite and the like can be cited for example, and the fraction of the structure to the entire structure is preferable to be 5 area % or less in total.

Identification of the structure and measurement of the fraction can be conducted in a method shown in the example described below.

In order to sufficiently exert excellent properties obtained by achieving the structure described above (high strength, high yield ratio and high workability) and to also exert other properties as the galvanized steel sheet (plating adhesion and weldability for example), the chemical componential composition of the steel sheet should be controlled as described below. The chemical componential composition will be described below in detail.

[C: 0.12-0.3%]

C contributes to making bainite and martensite hard in addition to improving quenchability, and is an element required for securing strength of the steel sheet. When the C amount is of shortage, not only ferrite is generated much but also bainite and martensite become soft, and therefore it becomes difficult to achieve high yield ratio and high strength. Accordingly, in the present invention, the C amount was stipulated to be 0.12% or more, preferably 0.13% or more, and more preferably 0.14% or more. On the other hand, when C is contained excessively high, weldability is deteriorated, and therefore the C amount is to be 0.3% or less, preferably 0.26% or less, and more preferably 0.23% or less.

[Si: 0.1% or Less (Excluding 0%)]

Although Si is an element effective in solution strengthening of ferrite, it is also an element deteriorating plating adhesion, and therefore it is preferable to be as little as possible in the present invention. Accordingly, the Si amount is to be 0.1% or less, preferably 0.07% or less, more preferably 0.05% or less, and further more preferably 0.03% or less.

[Mn: 2.0-3.5%]

Mn is an element improving quenchability and contributing to secure high strength. When the Mn amount is of shortage, quenchability becomes insufficient, ferrite is generated much, and it becomes difficult to achieve high strength and high yield ratio. Accordingly, in the present invention, Mn is contained by 2.0% or more, preferably 2.3% or more. On the other hand, when Mn is contained excessively high, strength-elongation balance and weldability are liable to deteriorate, and therefore the Mn amount is to be 3.5% or less, preferably 3.2% or less.

[P: 0.05% or Less (Excluding 0%)]

Although P is an element effective in solution strengthening of ferrite, it is also an element deteriorating plating adhesion, and therefore it is preferable to be as little as possible in the present invention. Accordingly, the P amount is to be 0.05% or less, preferably 0.03% or less.

[S: 0.05% or Less (Excluding 0%)]

S is an unavoidable impurity element, is preferable to be as little as possible from the viewpoint of securing workability and weldability, and therefore is to be 0.05% or less, preferably 0.02% or less, and more preferably 0.01% or less.

[Al: 0.005-0.1%]

Al is an element having a deoxidizing action, and is to be 0.005% or more, preferably 0.01% or more, and more preferably 0.02% or more. However, even when Al is added excessively high, the effect thereof saturates, and therefore the upper limit of the Al amount is to be 0.1%. The Al amount is to be preferably 0.08% or less, and more preferably 0.06% or less.

[N: 0.015% or Less (Excluding 0%)]

N is an unavoidable impurity element, tends to deteriorate toughness and elongation when contained much, and therefore the upper limit of the N amount is to be 0.015%. The N amount is to be preferably 0.01% or less, and more preferably 0.005% or less.

The fundamental composition of the steel used in the present invention is as described above, and the balance is iron and unavoidable impurities. As the unavoidable impurities brought in due to the situations of raw materials, materials, manufacturing facilities and the like, in addition to S and N described above, O, tramp elements (Sn, Zn, Pb, As, Sb, Bi and the like) and the like can be cited.

The steel used in the present invention may further contain optional elements described below according to the necessity.

[One Element or More Selected From a Group Consisting of Cr: 1.0% or Less (Excluding 0%), Mo: 1.0% or Less (Excluding 0%), and B: 0.01% or Less (Excluding 0%)]

All of Cr, Mo and B are elements improving quenchability and contributing to securing high strength. In order to exert such effect, it is preferable to contain Cr by 0.04% or more, Mo by 0.04% or more, and B by 0.0010% or more. However, when Cr and Mo are contained excessively high, elongation deteriorates, and therefore the upper limit of each is preferable to be 1.0% or less. It is more preferable that Cr is 0.50% or less and Mo is 0.50% or less. However, when B is contained excessively high, not only the effect thereof saturates, but also elongation deteriorates, and therefore the upper limit of the B amount is preferable to be 0.01%, more preferably 0.005%.

[Ti: 0.3% or Less (Excluding 0%) and/or V: 0.3% or Less (Excluding 0%)]

Ti and V are elements contributing to securing high strength by precipitating carbonitride and miniaturizing the structure. In order to exert such effect sufficiently, it is preferable to contain Ti by 0.01% or more, and V by 0.01% or more. However, even when either element is contained excessively high, the effects saturate only, and therefore the upper limit of each is preferable to be 0.3%. It is more preferable that the Ti amount is 0.20% or less and the V amount is 0.20% or less.

In order to manufacture the hot-dip galvanized steel sheet of the present invention, it is effective to conduct annealing after cold rolling in particular so as to satisfy the conditions described below. The annealing step will be described in detail below referring to FIG. 1.

Also, the manufacturing step of the hot-dip galvanized steel sheet (GI) and the alloyed hot-dip galvanized steel sheet (GA) of the present invention is one in which, in the step shown in FIG. 1, an ordinary plating step or an additional ordinary alloying step are added to the step (or between the steps) such as during the low temperature holding step, or between the low temperature holding step and the third cooling step, or during the third cooling step.

[Soaking for 5-200 Seconds (Soaking Time t1) in the Temperature Range (Soaking Temperature T1) of $Ac_3$ Point-($Ac_3$ Point+150° C.)]

A cold rolled steel sheet satisfying the componential composition described above is heated and soaked for 5-200 seconds (soaking time t1) in the temperature range (soaking temperature T1) of $Ac_3$ point-($Ac_3$ point+150° C.). When the soaking temperature T1 is below $Ac_3$ point, austenitic transformation becomes insufficient, ferrite remains much, and it becomes difficult to secure the desired structure. Also, because the process strain is liable to remain in ferrite, excellent elongation property is hardly obtained. The soaking temperature T1 is preferably ($Ac_3$ point+10° C.) or above. On the other hand, when the soaking temperature T1 is higher than ($Ac_3$ point+150° C.), grain growth of austenite is promoted, the structure is coarsened, and strength-elongation balance deteriorates which is not preferable. The soaking temperature T1 is preferably ($Ac_3$ point+100° C.) or below.

The soaking time t1 is to be 5-200 seconds. When the soaking time t1 is less than 5 seconds, austenitic transformation becomes insufficient, ferrite remains much, and it becomes difficult to secure the desired structure. Also, when the process strain remains in ferrite, excellent elongation property is hardly obtained. The soaking time t1 is preferably 20 seconds or more. On the other hand, when the soaking time t1 is too long, grain growth of austenite is promoted, the structure is coarsened as described above, and strength-elongation balance is liable to deteriorate. Accordingly, the soaking time t1 is to be 200 seconds or less, preferably 120 seconds or less.

Figure 2:
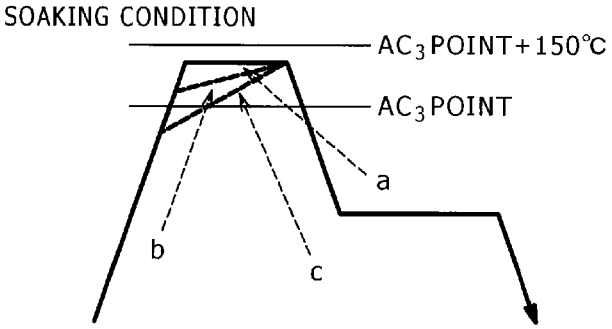
FIG. 2 is a schematic drawing showing a modification of a heat pattern in manufacturing the steel sheet of the present invention.

Also, the soaking temperature T1 does not have to be a constant temperature, and 5-200 seconds of the soaking time t1 in the temperature range (T1) of $Ac_3$ point-($Ac_3$ point+150° C.) only has to be secured in raising the temperature from the room temperature. Accordingly, for example, an aspect in which the temperature is raised to a maximum reaching temperature at a stretch and is held thereafter at the temperature as shown in (a) of FIG. 2 and an aspect in which 5-200 seconds of the soaking time t1 at the soaking temperature T1 is secured while the temperature is further raised within the temperature range of $Ac_3$ point-($Ac_3$ point+150° C.) after the temperature reaches the temperature range as shown in (b) of FIG. 2 and while the temperature is raised from a temperature below T1 to a maximum reaching temperature as shown in (c) of FIG. 2 are also included in the present invention.

Also, the average heating rate HR from the room temperature to the soaking temperature T1 in FIG. 1 is not particularly limited, and can be 1-100° C./second for example.

[Average Cooling Rate (CR1) From T1 to Temperature Range of 380-460° C. (T2): 3-30° C./Second]

In order to satisfy the fraction of ferrite described above, it is effective to make the average cooling rate (CR1) from T1 to the temperature range of 380-460° C. (T2) to be 3-30° C./second. When the average cooling rate CR1 is higher than 30° C./second, 3% or more of ferrite is hardly secured, and therefore it becomes difficult to secure elongation property. The average cooling rate CR1 is preferable to be 25° C./second or less. On the other hand, when average cooling rate CR1 is less than 3° C./second, ferritic transformation proceeds, the fraction of ferrite is hardly suppressed to 20% or less, and therefore it becomes difficult to secure a high yield ratio. The average cooling rate CR1 is preferable to be 5° C./second or more.

Cooling from T1 to the temperature range of 380-460° C. (T2) can be divided into multi stages, and in this case, the cooling rate of each stage is not particularly limited as far as the average cooling rate from T1 to the temperature range of 380-460° C. (T2) is within the range of 3-30° C./second. For example, as shown in the examples described below, two stage cooling may be adopted in which the first cooling rate (CR11) from T1 to an intermediate temperature (for example 500-700° C.) and the second cooling rate (CR12) from the intermediate temperature to the temperature range of 380-460° C. (T2) can be changed from each other.

[Heating for 20-300 Seconds (Low Temperature Holding Time t2) at Temperature Range of 380-460° C. (Low Temperature Holding Temperature T2)]

After cooling to the low temperature holding temperature T2 at the average cooling rate (CR1), 20-300 seconds (low temperature holding time t2) is secured at the temperature range of 380-460° C. (low temperature holding temperature T2). Although bainitic transformation occurs even at a temperature below 380° C., in manufacturing GI and GA, the temperature of plating bath is excessively dropped, and drop of productivity is worried about. At a temperature higher than 460° C., bainitic transformation hardly occurs, and a desired structure with the main phase of bainite cannot be secured. By being held at the temperature of 380-460° C. at which bainitic transformation easily occurs, a desired structure with the main phase of bainite can be secured. The low temperature holding temperature T2 is preferable to be 390° C. or above, more preferably 400° C. or above.

Also, the low temperature holding time t2 is to be 20-300 seconds. When the low temperature holding time t2 is less than 20 seconds, bainitic transformation does not occur sufficiently, and therefore it becomes difficult to secure a desired structure. The low temperature holding time t2 is preferable to be 25 seconds or more. On the other hand, even when the low temperature holding time t2 exceeds 300 seconds, bainitic transformation does not proceed any more, productivity drops, and therefore the upper limit of the low temperature holding time t2 is to be 300 seconds. The low temperature holding time t2 is preferably 200 seconds or less, more preferably 120 seconds or less.

Figure 3:
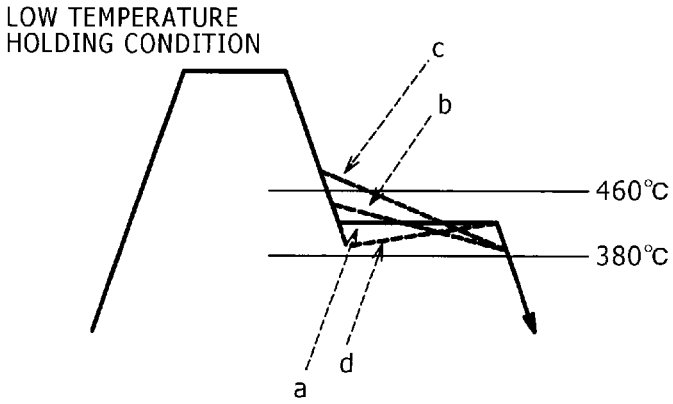
FIG. 3 is a schematic drawing showing another modification of a heat pattern in manufacturing the steel sheet of the present invention.

The low temperature holding temperature T2 does not have to be a constant temperature, and 20-300 seconds of the heating time at the temperature range of 380-460° C. only has to be secured in cooling from the soaking temperature T1. Accordingly, for example, as shown in (a) of FIG. 3, an aspect of cooling from the soaking temperature T1 to the low temperature holding temperature T2 at a stretch and being held thereafter at the temperature may be adopted. As shown in (b) of FIG. 3, after reaching the low temperature holding temperature T2, the steel sheet may be cooled further in the temperature range. Also, as shown in (c) of FIG. 3, while the steel sheet is cooled from the temperature exceeding 460° C. to the low temperature holding temperature T2, 20-300 seconds of the time when the temperature of the steel sheet is within the temperature range of 380-460° C. only has to be secured. Also, as shown in (d) of FIG. 3, the temperature may be raised within the temperature range of 380-460° C.

Thus, by controlling the low temperature holding temperature T2 and the low temperature holding time t2, the fraction of bainite is controlled.

Also, in manufacturing a hot-dip galvanized steel sheet (GI), after going through the low temperature holding step, hot-dip zinc plating may be performed by immersion in the plating bath (temperature: approximately 430-500° C.) for example, and the third cooling may be performed thereafter. Further, in manufacturing an alloyed hot-dip galvanized steel sheet (GA), after hot-dip zinc plating described above, the steel sheet may be heated to a temperature of approximately 500-750° C., may be thereafter alloyed, and may be thereafter subjected to the third cooling.

Further, in the middle of the low temperature holding step, plating treatment and alloying treatment may be performed, however in that case, the total of the time held at 380-460° C. before and after the plating treatment and alloying treatment should satisfy 20-300 s. Also, plating treatment and alloying treatment may be performed during the third cooling.

Further, the average cooling rate CR2 from the temperature range of 380-460° C. (T2) to the room temperature in FIG. 1 is not particularly limited, and can be 1-100° C./second for example.

Also, because austenite remaining after ferrite and bainite have transformed becomes to martensite, the fraction of martensite can be controlled by controlling the fraction of ferrite and the fraction of bainite.

The manufacturing conditions other than the above may be as per normal methods and are not particularly limited. For example, with respect to hot rolling, the finishing rolling temperature can be $Ac_3$ point or above, and the winding temperature can be 400-700° C. for example. After the hot rolling, acid washing can be performed according to the necessity, and cold rolling can be performed with the cold rolling ratio of 35-80% for example. Also, the conditions of plating and alloying other than the heating conditions described above in hot-dip zinc plating and alloyed hot-dip zinc plating can also adopt the conditions normally used.

EXAMPLES

Although the present invention will be explained below further specifically referring to examples, the present invention is not limited by the examples below, and it is a matter of course that the present invention can be also implemented with modifications being added appropriately within the scope adaptable to the purposes described above and below, and any of them is to be included within the technical range of the present invention.

Example 1

Slab steels (plate thickness: 25 mm) with the chemical composition shown in Table 1 were manufactured by melting according to a normal melting method and casting, and were thereafter hot-rolled to 2.4 mm thickness (the finishing rolling temperature was 880° C. and the winding temperature was 560° C.). Then, the hot rolled steel sheets obtained were acid-washed, and were thereafter cold-rolled to 1.2 mm thickness (cold rolling ratio: 50%).

Next, annealing treatment simulating a continuous plating and annealing line was performed in the laboratory under the annealing conditions shown in Table 2.

TABLE 1

| Steel | Chemical composition (mass %) *Balance is iron and unavoidable impurities. | | | | | | | | | | | | $AC_3$ |
|---|---|---|---|---|---|---|---|---|---|---|---|---|---|
| No. | C | Si | Mn | P | S | Al | N | Cr | Mo | B | Ti | V | point |
| A | 0.169 | 0.01 | 2.60 | 0.010 | 0.002 | 0.042 | 0.0019 | 0.36 | 0.07 | | 0.071 | | 799 |
| B | 0.142 | <0.01 | 2.60 | 0.009 | 0.003 | 0.043 | 0.0012 | 0.36 | 0.07 | | 0.070 | | 805 |
| C | 0.112 | 0.01 | 2.75 | 0.009 | 0.002 | 0.043 | 0.0014 | 0.24 | 0.07 | | 0.069 | | 811 |
| D | 0.165 | 0.01 | 2.60 | 0.009 | 0.002 | 0.042 | 0.0009 | 0.31 | 0.07 | | 0.099 | | 811 |

TABLE 1-continued

| Steel | Chemical composition (mass %) *Balance is iron and unavoidable impurities. | | | | | | | | | | | | $AC_3$ |
|---|---|---|---|---|---|---|---|---|---|---|---|---|---|
| No. | C | Si | Mn | P | S | Al | N | Cr | Mo | B | Ti | V | point |
| E | 0.190 | <0.01 | 2.59 | 0.009 | 0.003 | 0.042 | 0.0014 | 0.31 | 0.07 | | | | 766 |
| F | 0.164 | <0.01 | 2.58 | 0.009 | 0.002 | 0.043 | 0.0015 | 0.31 | 0.07 | | | | 773 |
| G | 0.139 | <0.01 | 2.61 | 0.009 | 0.003 | 0.042 | 0.0013 | 0.51 | 0.07 | | 0.071 | | 804 |
| H | 0.169 | <0.01 | 2.65 | 0.010 | 0.003 | 0.044 | 0.0014 | 0.23 | 0.07 | | 0.069 | | 799 |
| I | 0.219 | <0.01 | 1.91 | 0.010 | 0.002 | 0.043 | 0.0011 | 0.24 | 0.07 | | 0.069 | | 809 |
| J | 0.205 | <0.01 | 3.03 | 0.010 | 0.003 | 0.043 | 0.0012 | | | | | | 751 |
| K | 0.195 | <0.01 | 2.82 | 0.009 | 0.002 | 0.042 | 0.0012 | 0.36 | | | | | 755 |
| L | 0.196 | <0.01 | 2.82 | 0.009 | 0.002 | 0.042 | 0.0013 | | 0.40 | | | | 771 |
| M | 0.205 | <0.01 | 3.03 | 0.009 | 0.003 | 0.044 | 0.0012 | | | | 0.045 | | 769 |
| N | 0.152 | <0.01 | 2.50 | 0.009 | 0.002 | 0.042 | 0.0013 | | | 0.0015 | | | 779 |
| O | 0.150 | 0.01 | 2.64 | 0.010 | 0.002 | 0.043 | 0.0012 | 0.31 | 0.07 | 0.0015 | 0.069 | | 803 |
| P | 0.205 | <0.01 | 3.03 | 0.009 | 0.003 | 0.042 | 0.0015 | | | | | 0.071 | 758 |
| Q | 0.111 | <0.01 | 3.03 | 0.009 | 0.002 | 0.043 | 0.0013 | | | | | | 775 |
| R | 0.204 | <0.01 | 1.89 | 0.009 | 0.003 | 0.044 | 0.0012 | | | | | | 786 |
| S | 0.204 | <0.01 | 4.51 | 0.009 | 0.003 | 0.044 | 0.0012 | | | | | | 707 |

Also, with respect to the calculation formula of $Ac_3$ point in Table 1 above, "Leslie Tekkou Zairyougaku" (William C. Leslie, The Physical Metallurgy of Steels, translated under the supervision of Shigeyasu Kouda, Maruzen Co., Ltd., 1985, p. 273) was referred (the same with respect to Table 4 below).

TABLE 2

| | | Annealing condition | | | | | | | | | |
|---|---|---|---|---|---|---|---|---|---|---|---|
| Experiment No. | Steel No. | Heating rate HR ° C./sec | Soaking temperature T1 ° C. | Soaking time t1 sec | Cooling rate of first cooling CR11 ° C./sec | Intermediate temperature ° C. | Cooling rate of second cooling CR12 ° C./sec | Average cooling rate CR1 ° C./sec | Low temperature holding temperature T2 ° C. | Low temperature holding time t2 sec | Cooling rate of third cooling CR2 ° C./sec |
| 1 | A | 15.0 | 850 | 50 | 7.1 | 700 | 46.7 | 15.9 | 420 | 45 | 10.0 |
| 2 | B | 15.0 | 875 | 50 | 13.1 | 600 | 33.3 | 17.6 | 400 | 45 | 10.0 |
| 3 | D | 15.0 | 850 | 50 | 7.1 | 700 | 46.7 | 15.9 | 420 | 45 | 10.0 |
| 4 | E | 15.0 | 850 | 50 | 7.1 | 700 | 40.0 | 14.4 | 460 | 45 | 10.0 |
| 5 | G | 15.0 | 900 | 50 | 14.3 | 600 | 30.0 | 17.8 | 420 | 45 | 10.0 |
| 6 | H | 3.0 | 850 | 70 | 2.2 | 725 | 16.6 | 5.9 | 410 | 70 | 10.0 |
| 7 | E | 15.0 | 850 | 50 | 11.9 | 600 | 20.0 | 13.7 | 480 | 45 | 10.0 |
| 8 | F | 15.0 | 850 | 50 | 11.9 | 600 | 20.0 | 13.7 | 480 | 45 | 10.0 |
| 9 | C | 15.0 | 850 | 50 | 9.5 | 650 | 25.0 | 13.0 | 500 | 45 | 10.0 |
| 10 | C | 15.0 | 850 | 50 | 9.5 | 650 | 38.3 | 15.9 | 420 | 45 | 10.0 |
| 11 | I | 15.0 | 850 | 50 | 9.5 | 650 | 38.3 | 15.9 | 420 | 45 | 10.0 |
| 12 | H | 15.0 | 775 | 50 | 6.0 | 650 | 38.3 | 13.1 | 420 | 45 | 10.0 |
| 13 | H | 15.0 | 850 | 50 | 9.5 | 650 | 25.0 | 13.0 | 500 | 45 | 10.0 |
| 14 | H | 15.0 | 850 | 50 | 9.5 | 650 | 38.3 | 15.9 | 420 | 10 | 10.0 |
| 15 | J | 15.0 | 830 | 50 | 8.6 | 650 | 33.3 | 14.1 | 450 | 45 | 10.0 |
| 16 | K | 15.0 | 830 | 50 | 8.6 | 650 | 33.3 | 14.1 | 450 | 45 | 10.0 |
| 17 | L | 15.0 | 830 | 50 | 8.6 | 650 | 33.3 | 14.1 | 450 | 45 | 10.0 |
| 18 | M | 15.0 | 850 | 50 | 8.3 | 675 | 42.5 | 15.9 | 420 | 45 | 10.0 |
| 19 | N | 15.0 | 830 | 50 | 11.0 | 600 | 25.0 | 14.1 | 450 | 45 | 10.0 |
| 20 | O | 15.0 | 850 | 50 | 9.5 | 650 | 33.3 | 14.8 | 450 | 45 | 10.0 |
| 21 | P | 15.0 | 850 | 50 | 9.5 | 650 | 38.3 | 15.9 | 420 | 45 | 10.0 |
| 22 | J | 15.0 | 830 | 50 | 11.0 | 600 | 16.7 | 12.2 | 500 | 45 | 10.0 |
| 23 | J | 15.0 | 830 | 50 | 11.0 | 600 | 25.0 | 14.1 | 450 | 10 | 10.0 |
| 24 | Q | 15.0 | 830 | 50 | 11.0 | 600 | 25.0 | 14.1 | 450 | 45 | 10.0 |
| 25 | R | 15.0 | 830 | 50 | 11.0 | 600 | 25.0 | 14.1 | 450 | 45 | 10.0 |
| 26 | S | 15.0 | 830 | 50 | 11.0 | 600 | 25.0 | 14.1 | 450 | 45 | 10.0 |

With respect to each steel sheet obtained as described above, measurement of mechanical properties (tensile strength, yield ratio, elongation), evaluation of stretch-flangeability, and observation of the structure were conducted as described below.

[Measurement of Mechanical Properties]

No. 5 specimen of JIS Z 2201 was taken, and the tensile strength (TS), yield strength (YS) and total elongation (EL) were measured according to JIS Z 2241. From these values, the yield ratio (YR) and TS×EL were calculated. TS of 980 MPa or more was evaluated to be high strength, and YR of 65% or more was evaluated to be high yield ratio. Also, with respect to EL, the case TS×EL/100 was 130 or more was evaluated to be excellent in the balance of the strength and elongation (TS-EL balance).

[Evaluation of Stretch-Flangeability]

A specimen was taken according to the method stipulated in The Japan Iron and Steel Federation standards JFS T 1001, after punching a hole with the initial hole diameter di=10 mm Φ, a circular cone punch with 60° apex angle was pushed in, and the punched hole was expanded. Also, the hole diameter db of the time when the crack generated in the punched hole part penetrated the plate thickness was obtained, and the hole expanding limit (may be described in the present specification as "hole expansion ratio") λ (%) was calculated according to the formula below. Further, in the present example, the case tensile strength (TS)×hole expansion ratio (λ)/100 was 210 or more was evaluated to be excellent in the balance of the strength and stretch-flangeability (TS-λ balance).

[Observation of Structure (Micro Structure Observation)]

Also, the fraction of bainite was obtained by deducting the fractions of ferrite and martensite described above from the entire structure (100 area %).

The result of these measurements is shown in Table 3.

TABLE 3

| | | Micro structure | | | Mechanical properties | | | | | | |
|---|---|---|---|---|---|---|---|---|---|---|---|
| Experiment No. | Steel No. | VF % | VM % | VB % | YP MPa | TS MPa | YR % | EL % | TS × EL/100 MPa | λ % | TS × λ/100 MPa |
| 1 | A | 7 | 21 | 72 | 734 | 1010 | 73 | 16.5 | 166.7 | 34.1 | 344 |
| 2 | B | 16 | 29 | 55 | 665 | 1024 | 65 | 14.7 | 150.5 | 25.0 | 256 |
| 3 | D | 11 | 18 | 71 | 763 | 998 | 76 | 18.0 | 179.6 | 29.2 | 291 |
| 4 | E | 4 | 11 | 85 | 668 | 979 | 68 | 16.1 | 157.6 | 21.8 | 213 |
| 5 | G | 13 | 22 | 65 | 663 | 1003 | 66 | 15.3 | 153.0 | 22.0 | 220 |
| 6 | H | 14 | 17 | 69 | 698 | 1019 | 69 | 16.5 | 168.1 | 24.6 | 251 |
| 7 | E | 7 | 41 | 52 | 667 | 1077 | 62 | 14.3 | 154.0 | 17.3 | 186 |
| 8 | F | 14 | 38 | 48 | 619 | 1089 | 57 | 13.4 | 145.9 | 13.5 | 146 |
| 9 | C | 29 | 47 | 24 | 569 | 998 | 57 | 16.4 | 163.7 | 19.2 | 192 |
| 10 | C | 27 | 28 | 45 | 542 | 921 | 59 | 18.5 | 170.4 | 21.1 | 194 |
| 11 | I | 33 | 32 | 35 | 534 | 931 | 57 | 17.9 | 166.6 | 21.8 | 203 |
| 12 | H | 25 | 33 | 42 | 710 | 1128 | 63 | 10.5 | 118.4 | 11.8 | 133 |
| 13 | H | 17 | 64 | 19 | 685 | 1187 | 58 | 12.5 | 148.4 | 14.1 | 167 |
| 14 | H | 14 | 57 | 29 | 664 | 1167 | 57 | 13.1 | 152.9 | 14.5 | 169 |
| 15 | J | 7 | 18 | 75 | 669 | 1003 | 67 | 14.9 | 149.4 | 22.6 | 227 |
| 16 | K | 12 | 20 | 68 | 682 | 1030 | 66 | 14.3 | 147.3 | 22.1 | 228 |
| 17 | L | 10 | 17 | 73 | 678 | 995 | 68 | 15.2 | 151.2 | 24.7 | 246 |
| 18 | M | 14 | 21 | 65 | 685 | 1023 | 67 | 14.3 | 146.3 | 23.5 | 240 |
| 19 | N | 13 | 32 | 55 | 720 | 1067 | 67 | 13.2 | 140.8 | 21.2 | 226 |
| 20 | O | 9 | 30 | 61 | 792 | 1195 | 66 | 11.8 | 141.0 | 16.9 | 202 |
| 21 | P | 17 | 24 | 59 | 690 | 1035 | 67 | 13.8 | 142.8 | 21.1 | 218 |
| 22 | J | 11 | 57 | 32 | 779 | 1285 | 61 | 9.9 | 127.2 | 13.1 | 168 |
| 23 | J | 13 | 54 | 33 | 755 | 1259 | 60 | 10.4 | 130.9 | 14.1 | 178 |
| 24 | Q | 24 | 30 | 46 | 530 | 892 | 59 | 17.8 | 158.8 | 18.6 | 166 |
| 25 | R | 35 | 29 | 36 | 511 | 901 | 57 | 18.2 | 164.0 | 17.3 | 156 |
| 26 | S | 0 | 68 | 32 | 932 | 1401 | 67 | 6.4 | 89.7 | 17.0 | 238 |

The fraction of martensite was measured by a method described below. The cross section of the steel sheet obtained as described above perpendicular to the rolling direction was polished and was subjected to nital corrosion, and thereafter the measurement region of approximately 30 μm×30 μm of one field of view was observed under a scanning electron microscope of 3,000 magnifications. Observation was conducted with respect to three fields of view, and the arithmetic average of martensite area ratio measured by a point counting method was obtained.

The fraction of ferrite was measured by a method described below. In order to identify ferrite, with respect to the cross section perpendicular to the rolling direction of the steel sheet obtained as described above, crystal orientation analysis was conducted by an EBSP method using a scanning electron microscope. In the EBSP method, the crystal orientation of the measurement region of approximately 30 μm×30 μm was measured with the step size of 0.1 μm. All of the orientation difference between adjacent two points inside the crystal grain surrounded by a large inclination angle grain boundary of 15° or more in terms of the crystal orientation difference was calculated, the value thereof averaged with respect to the entity inside the grain was made to be the average intra-grain orientation difference, and one with 0.35° or less of the same was identified to be ferrite. Observation was conducted with respect to three fields of view with 3,000 magnifications, the arithmetic average of ferrite area ratio measured by the point counting method was obtained.

With respect to the crystal orientation analysis by the EBSP method using a scanning electron microscope, Tetsu-to-Hagane (Journal of the Iron and Steel Institute of Japan, vol. 94 (2008) No. 8, p. 313) was referred.

Form Tables 1-3, following study is possible. That is, in experiment Nos. 1-6 and 15-21, the requirement stipulated in the present invention was satisfied, so that the steel sheets having 980 MPa or more tensile strength, exhibiting high yield ratio and excellent in TS-EL balance and TS-λ balance were obtained. On the other hand, in experiment Nos. 7-14 and 22-26, because the requirement stipulated in the present invention was not satisfied, the required properties were not obtained.

More specifically, in experiment Nos. 7, 8, and 13, the low temperature holding temperature T2 was too high, so that the fraction of martensite exceeded the stipulated range, and high yield ratio could not be achieved.

In experiment No. 9, the steel kind C whose C amount was insufficient was used and the low temperature holding temperature T2 was too high, so that both of the fractions of ferrite and martensite exceeded the stipulated range, and high yield ratio could not be achieved.

In experiment Nos. 10 and 24, because the steel kind C (No. 10) and the steel kind Q (No. 24) whose C amount was insufficient were used, ferrite was formed excessively, and high strength and high yield ratio could not be achieved.

In experiment Nos. 11 and 25, because the steel kind I whose Mn amount was insufficient was used, ferrite was formed excessively, and high strength and high yield ratio could not be achieved.

In experiment No. 12, because the soaking temperature T1 was too low, ferrite was formed excessively, the process strain remained in ferrite, and excellent elongation property could not be obtained.

In experiment No. 14, because the low temperature holding time t2 was too short, bainite was not formed sufficiently, martensite became excessive, and yield ratio dropped.

In experiment No. 22, because the low temperature holding temperature T2 was too high, the fraction of martensite exceeded the stipulated range, and high yield ratio could not be achieved. Also, because the fraction of martensite was high and the tensile strength (TS) was also high, elongation property (El) was inferior.

In experiment No. 23, because the low temperature holding time t2 was too short, bainite was not formed sufficiently, martensite became excessive, and yield ratio dropped. Also, because the fraction of martensite was high and the tensile strength (TS) was also high, elongation property was also inferior.

In experiment No. 26, because the Mn amount was excessive, ferrite was not formed, martensite became excessive, and elongation property was inferior.

Figure 4:
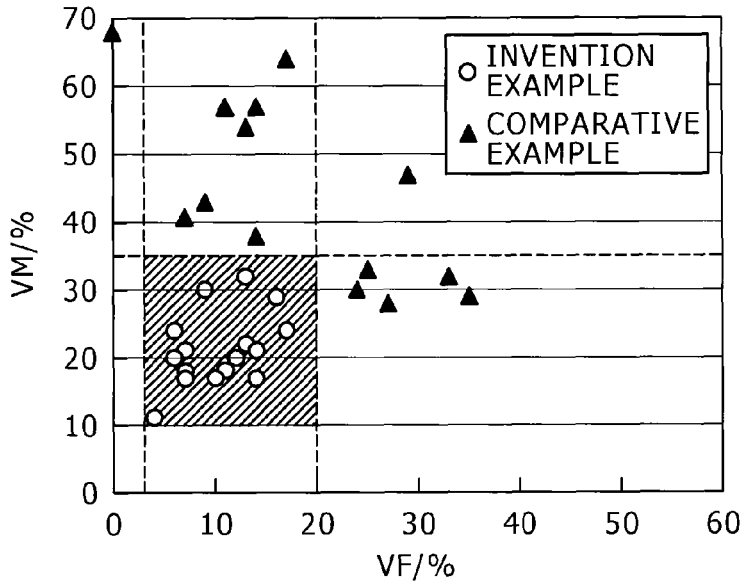
FIG. 4 is a drawing showing the structural fraction of the steel sheets obtained in an example.
Figure 5:
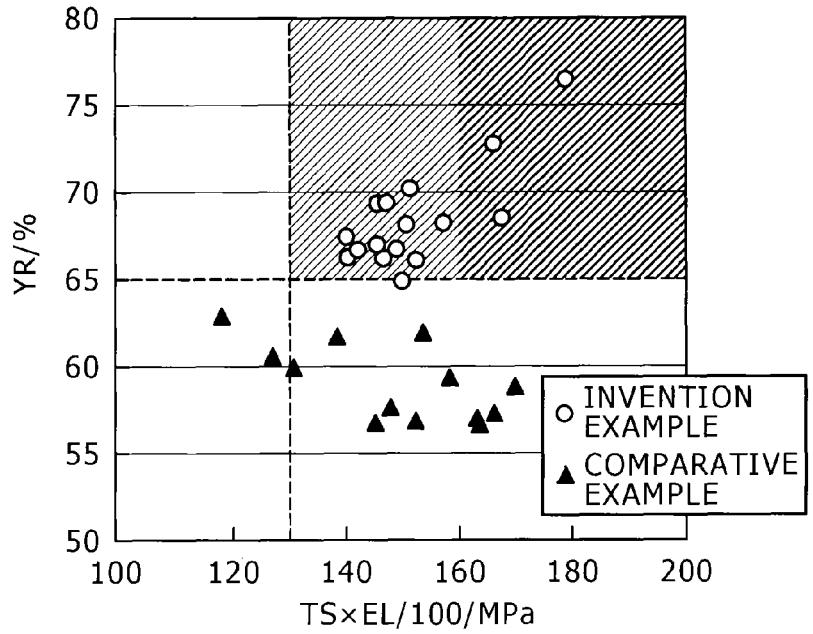
FIG. 5 is a drawing showing the mechanical properties of the steel sheets obtained in an example.

FIG. 4 is a drawing showing the structural fraction of the steel sheets obtained in the present example, and it is known that the fractions of ferrite and martensite of the steel sheets in relation with the present invention are within the stipulated range. Also, FIG. 5 is a drawing showing the mechanical properties of the steel sheets obtained in the present example, and it is known that by making the fractions of ferrite and martensite within the range of FIG. 4, both of high yield ratio and excellent workability (more specifically excellent strength-elongation balance) can be provided in the high strength region.

Also, in the present example, steel sheets before plating were used, however, it was confirmed by experiments that excellent properties described above were provided in a similar manner even in the galvanized steel sheets subjected to hot-dip zinc plating and alloyed hot-dip zinc plating.

Example 2

Steel with the chemical composition shown in Table 4 was molten by a converter, slab steel (plate thickness: 230 mm) was produced by continuous casting, and was thereafter hot-rolled to 2.3 mm thickness (the finishing rolling temperature in hot rolling was 880° C. and the winding temperature was 560° C.). Then, the hot rolled steel sheet obtained was acid-washed, and was thereafter cold-rolled to 1.4 mm thickness (cold rolling ratio: 39%).

Then, annealing and hot-dip zinc plating were conducted in the continuous plating and annealing line under the annealing condition shown in Table 5. Also, hot-dip zinc plating treatment was conducted after the low temperature holding step, and the third cooling was conducted after the plating treatment. The plating bath temperature was made 450° C. and the plating bath retention time was made 2 seconds then.

TABLE 4

| Steel | Chemical composition (mass %) *Balance is iron and unavoidable impurities. | | | | | | | | | | | | $AC_3$ point |
|---|---|---|---|---|---|---|---|---|---|---|---|---|---|
| No. | C | Si | Mn | P | S | Al | N | Cr | Mo | B | Ti | V | (° C.) |
| T | 0.184 | 0.02 | 2.48 | 0.011 | 0.003 | 0.048 | 0.0038 | 0.36 | 0.07 | | 0.066 | | 801 |

TABLE 5

| | | Annealing condition | | | | | | | | | |
|---|---|---|---|---|---|---|---|---|---|---|---|
| Experiment No. | Steel No. | Heating rate HR ° C./sec | Soaking temperature T1 ° C. | Soaking time t1 sec | Cooling rate of first cooling CR11 ° C./sec | Intermediate temperature ° C. | Cooling rate of second cooling CR12 ° C./sec | Average cooling rate CR1 ° C./sec | Low temperature holding temperature T2 ° C. | Low temperature holding time t2 sec | Cooling rate of third cooling CR2 ° C./sec |
| 27 | T | 15.0 | 860 | 50 | 10.0 | 650 | 40.0 | 16.7 | 410 | 45 | 10.0 |
| 28 | T | 15.0 | 860 | 50 | 10.0 | 650 | 43.3 | 17.4 | 390 | 45 | 10.0 |
| 29 | T | 15.0 | 860 | 50 | 10.0 | 650 | 35.0 | 15.6 | 440 | 45 | 10.0 |
| 30 | T | 15.0 | 860 | 50 | 10.0 | 650 | 28.3 | 14.1 | 480 | 45 | 10.0 |

With respect to each hot-dip galvanized steel sheet obtained as described above, measurement of mechanical properties (tensile strength, yield ratio, elongation), evaluation of stretch-flangeability, and observation of the structure were conducted similarly to the example 1. The result is shown in Table 6.

TABLE 6

| | | Micro structure | | | Mechanical properties | | | | | | |
|---|---|---|---|---|---|---|---|---|---|---|---|
| Experiment No. | Steel No. | VF % | VM % | VB % | YP MPa | TS MPa | YR % | EL % | TS × EL/100 MPa | λ % | TS × λ/100 MPa |
| 27 | T | 6 | 24 | 70 | 716 | 1020 | 70 | 14.9 | 152.0 | 20.4 | 208 |
| 28 | T | 6 | 20 | 74 | 730 | 1053 | 69 | 13.9 | 146.3 | 21.6 | 227 |
| 29 | T | 7 | 17 | 76 | 697 | 1005 | 69 | 14.7 | 147.7 | 24.5 | 246 |
| 30 | T | 9 | 43 | 48 | 687 | 1112 | 62 | 12.5 | 139.0 | 17.2 | 191 |

From Tables 4-6, following study is possible. That is, in experiment Nos. 27-29, since the requirement stipulated in the present invention was satisfied, the steel sheets having 980 MPa or more tensile strength, exhibiting high yield ratio and excellent in TS-EL balance and TS-λ balance were obtained. On the other hand, in experiment No. 30, the fraction of martensite exceeded the stipulated range, and high yield ratio could not be achieved.

From the result of the present example, it was confirmed that the GI steel sheets satisfying the requirement of the present invention were provided with excellent properties. Although the result of the GI steel sheets were shown in the present example, it was confirmed that, even in GA steel sheets subjected to alloying treatment thereafter, those satisfying the requirement of the present invention were provided with excellent properties.

The invention claimed is:

1. A galvanized steel sheet, comprising, in mass percent:

C: 0.12-0.3%;

Si: greater than 0 and 0.1% or less;

Mn: 2.0-3.5%;

P: greater than 0 and 0.05% or less;

S: greater than 0 and 0.05% or less;

Al: 0.005-0.1%;

N: greater than 0 and 0.015% or less; with the balance being iron and unavoidable impurities, and a hot-dip zinc plating layer or an alloyed hot-dip zinc plating layer on the surface of the galvanized steel sheet, wherein the galvanized steel sheet has a tensile strength of 980 MPa or more, excellent workability and high yield ratio, metallic structure thereof contains bainite as a matrix structure, an area ratio of ferrite: 3-18%; and an area ratio of martensite: 10-35% in terms of ratio to the entire structure.

2. The galvanized steel sheet according to claim 1, further comprising at least one of:

Cr: greater than 0 and 1.0% or less;

Mo: greater than 0 and 1.0% or less; and

B: greater than 0 and 0.01% or less.

3. The galvanized steel sheet according to claim 1, further comprising at least one of:

Ti: greater than 0 and 0.3% or less, and

V: greater than 0 and 0.3% or less.

4. The galvanized steel sheet according to claim 1, comprising an area fraction of martensite: 10-30% in terms of ratio to the entire structure.

5. The galvanized steel sheet according to claim 1, comprising C: 0.12-0.26%.

6. The galvanized steel sheet according to claim 1, comprising C: 0.12-0.23%.

7. The galvanized steel sheet according to claim 1, comprising Si: greater than 0 and 0.07% or less.

8. The galvanized steel sheet according to claim 1, comprising Si: greater than 0 and 0.05% or less.

9. The galvanized steel sheet according to claim 1, comprising Si: greater than 0 and 0.03% or less.

10. The galvanized steel sheet according to claim 1, comprising Mn: 2.3-3.2%.

11. The galvanized steel sheet according to claim 1, comprising P: greater than 0 and 0.03% or less.

12. The galvanized steel sheet according to claim 1, comprising S: greater than 0 and 0.02% or less.

13. The galvanized steel sheet according to claim 1, comprising S: greater than 0 and 0.01% or less.

14. The galvanized steel sheet according to claim 1, comprising Al: 0.005-0.08%.

15. The galvanized steel sheet according to claim 1, comprising Al: 0.005-0.06%.

16. The galvanized steel sheet according to claim 1, comprising N: greater than 0 and 0.01% or less.

17. The galvanized steel sheet according to claim 1, comprising N: greater than 0 and 0.005% or less.

* * * * *